US005792264A

United States Patent [19]

Frati

[11] Patent Number: 5,792,264

[45] Date of Patent: Aug. 11, 1998

[54] GLUING MACHINE FOR WOOD FIBREBOARD PANEL PRODUCTION PLANTS, AND A PLANT USING THE GLUING MACHINE

[75] Inventor: Luigi Frati, Mantova, Italy

[73] Assignee: C.M.P. Costruzioni Meccaniche Pomponesco S.p.A., Mantova, Italy

[21] Appl. No.: 650,615

[22] Filed: May 20, 1996

[30] Foreign Application Priority Data

May 24, 1995 [IT] Italy ..... MI95A1065

[51] Int. Cl.[6] ..... B05B 17/00

[52] U.S. Cl. ..... 118/303; 118/300; 427/221; 427/222; 427/421

[58] Field of Search ..... 118/300, 303; 427/221, 222, 421

[56] References Cited

U.S. PATENT DOCUMENTS

| | | | |
|---|---|---|---|
| 4,116,163 | 9/1978 | Torelli et al. | 118/303 |
| 4,510,184 | 4/1985 | Winkler et al. | 118/303 |
| 4,511,603 | 4/1985 | Wallace | 118/303 |
| 4,997,681 | 3/1991 | Dockrill et al. | 118/303 |

FOREIGN PATENT DOCUMENTS

| | | |
|---|---|---|
| 0078960 | 5/1983 | European Pat. Off. . |
| 2580684 | 10/1986 | France . |
| 1632450 | 12/1970 | Germany . |
| 9011184 | 10/1990 | WIPO . |

OTHER PUBLICATIONS

Soviet Union Abstract No. 1638010, Mar. 30, 1991.

*Primary Examiner*—Laura Edwards
*Attorney, Agent, or Firm*—Steinberg, Raskin & Davidson, P.C.

[57] ABSTRACT

Gluing machine for use in plants for producing wood fibreboard panels by a dry process including a hollow cylindrical shell having an inlet opening at one end for feeding an air stream transporting the fibers within which the glue is to be distributed, and an outlet opening at an opposite end for removing the air stream transporting the glue-impregnated fibers. A sprayer is provided for spraying an adhesive onto the fibers flowing through the cylindrical shell. The machine includes members for maintaining the flowing fibers close to the inner wall of the cylindrical shell for a predetermined distance. The sprayer is positioned within the predetermined distance in which the fibers are maintained close to the inner surface of the cylindrical shell.

20 Claims, 2 Drawing Sheets

GLUING MACHINE FOR WOOD FIBREBOARD PANEL PRODUCTION PLANTS, AND A PLANT USING THE GLUING MACHINE

FIELD OF THE INVENTION

This invention relates to a gluing machine (also known as a resin-bonding machine) of the type usable in plants for producing wood fibreboard panels by a dry process, and in particular in plants for producing medium density fibreboard (MDF) panels.

The invention also relates to a plant for producing wood fibreboard panels by a dry process, which uses the gluing machine.

BACKGROUND OF THE INVENTION

As is well known to the expert of the art, MDF panels are produced by two types of known plant. A first plant type—which will be called a traditional plant and of which the characteristics will be described for the present purpose—is shown schematically in FIG. 1. In it, the reference numeral 10 indicates a grinder, ie a machine which, fed with wood and steam (this feed being indicated by the arrow 12), reduces the wood into fiber form. The fibers produced in this manner and mixed with steam (relative humidity 100%) leave the grinder 10 through a blow-up valve 14 and are conveyed by a line 16 to a drier 18. This latter is also fed, by a fan 19 and duct 20, with hot gas 22 and air 24 at ambient temperature to dry the fibers. For this purpose the drier interior is at a variable temperature adjustable from 120° C. to 250°C. The fibers dried in this manner are conveyed by a line 26 to a separator or cyclone 28, in which the dry fibre is separated from the steam and from the gas which develops during drying, the gas and steam being discharged to atmosphere, as indicated by the arrow 30. The fibers leaving the cyclone 28, which have a moisture content of between 2 and 5%, are fed by the line 32 to a continuously operating weigher 34 where they are metered. The fibers leaving the weigher 34 and fed into the line 36 are struck by an air stream 38 which transports them into a gluing or resin-bonding machine via a feed line 40. The purpose of the air stream 38 is to entrain the fibers while maintaining them separated from each other. Basically, the gluing machine 42 consists of a hollow cylindrical shell 44 arranged horizontally and having a circular cross-section, in which a mixing means is present consisting of a shaft 50 positioned coaxially in the cylindrical shell 44 and provided with radial paddles 52. The shaft 50 is rotatable and is rotated by a motor 54 positioned outside the gluing machine 42. The left end 46 of the gluing machine is traversed by a series of nozzles (shown schematically in the figure by arrows 48) distributed about the end, by means of which a liquid adhesive substance consisting normally of a conventional urea-formaldehyde glue previously mixed with water is sprayed into the gluing machine. As the shaft 50 rotates, the paddles 52 generate a mixing action on the fibers onto which the adhesive substance has been sprayed. These fibers are then fed via a line 56 to a conventional moulder 58 which itself feeds conventional presses, not shown in FIG. 1. Upstream of the moulder 58 a separator (not shown) can be provided for the purpose of separating fiber and glue lumps which may form in the gluing machine 42. The lumps separated in this manner can be used as fuel in a boiler (not shown) forming part of the plant.

The aforedescribed traditional plant has the advantage of low glue consumption and low formaldehyde emission into the atmosphere in correspondence with the reference numeral 30. However the described gluing machine does not enable the glue to be distributed in a sufficiently uniform manner within the fiber mass, with the result that this plant produces poor quality panels with the formation of lumps and stains which drastically limit the use of the product obtained. In particular the panels produced in this manner cannot be enhanced or lacquered. For the same reason these panels do not present mechanical and technological characteristics which are constant with time and uniform throughout the panel. These drawbacks are more noticeable if poorly reactive glues such as those of class E1 are used, having a low level of free formaldehyde. Moreover, as is well known to the expert of the art, the glues of class E1 enable panels to be produced containing free formaldehyde, and hence releasable, in a quantity not exceeding 8 mg per 100 g of panel. It is therefore normally necessary to use more reactive glues (of class E2 or E3) which however result in higher formaldehyde emission in the pressing stage, with resultant environmental problems. Finally, the fiber mass reaching the moulder 58 has a moisture content (between 2 and 5 wt %) which is lower than that necessary for pressing, with the result that this moisture content must be increased to between 8 and 11%.

A brief description will now be given with reference to FIG. 2 of a second type of plant, known in the art as a blow-line or glue-line plant, which enables better results to be obtained, even if accompanied by certain drawbacks such as a higher glue consumption (about 30–40% more), high formaldehyde emission to the stacks at the cyclone downstream of the drier, and a higher free formaldehyde content in the panels produced.

This plant is illustrated schematically in FIG. 2 (wherein the number "1" is added before the reference numerals of FIG. 1 which designate the same elements as shown in the embodiment in FIG. 1 unless otherwise noted) and comprises a grinder 110 similar to that (10) of the plant of FIG. 1. The fibers leaving this latter through the blow-up valve 114 are fed (represented schematically by arrow 148), before they enter the drier 118, with a suitable quantity of liquid adhesive substance (of similar type to that used in the first plant) via a suitable nozzle (not shown) directly into the pipe 116. Hence a fiber mass which has already absorbed the adhesive substance is fed into the drier 118 via the line 116.

The plant also comprises a cyclone 128 and a weigher 134 similar to those of FIG. 1, however there is no gluing machine (and hence no machine similar to that indicated by 42 in FIG. 1) because it is unnecessary. Consequently the glue-impregnated fiber leaving the weigher 134 is directly fed, via the line 136, to the moulder 158 (similar to the moulder 58 of FIG. 1) at which the glue-impregnated fibers arrive already with a moisture content of 8–11 wt %, suitable for the pressing. With this second type of plant excellent glue distribution is achieved, so that the panels obtained as final product are of excellent quality and can also be enhanced or lacquered. However the fact of subjecting the adhesive substance to a temperature which can reach 200° C. in the drier 118 causes a fall in the glue reactivity which, as stated, means that the quantity of adhesive substance must be increased and/or glues of class E2 or E3 (ie more reactive) must be used. Finally there is a higher formaldehyde emission through the stacks (reference 130) and during the pressing stage.

OBJECTS AND SUMMARY OF THE INVENTION

The object of the present invention is to provide a gluing machine usable both in plants of the first plant type defined heretofore as traditional and in a new plant type described hereinafter, the gluing machine enabling excellent glue distribution to be achieved throughout the fiber mass used for forming the panel.

This object is attained by the gluing machine of the present invention, comprising a hollow cylindrical shell, at one end of which there is provided an inlet opening for feeding an air stream transporting the fibers within which the glue is to be distributed, at the other end of the cylindrical shell there being provided an outlet opening-for removing the air stream transporting the glue-impregnated fibers, and a sprayer means for spraying a suitable liquid adhesive substance onto the fibers flowing through the cylindrical shell, characterised by also comprising means for maintaining the flowing fibers close to the inner wall of the cylindrical shell for a predetermined distance, the sprayer means being positioned within said distance in which the fibers are maintained close to the inner surface of the cylindrical shell.

According to one embodiment of the invention, the means for maintaining the fibers in proximity to the inner lateral wall of the cylindrical shell comprise a pipe, an open end of which opens into the cylindrical shell in the vicinity of the sprayer means, the pipe extending coaxially upstream at least for a certain distance before emerging from the cylindrical shell, an air stream being fed into the other end of the pipe.

The gluing machine of the present invention can comprise a mixing means disposed in that portion of the cylindrical shell downstream of the position in which the fibers are struck by the spray of adhesive substance. This mixing means can consist of a conventional rotatable shaft provided with paddles arranged coaxially to the cylindrical shell.

The aforedescribed gluing machine can be conveniently used as a replacement for the conventional gluing machine 42 of the traditional plant shown in FIG. 1. Using it, with the plant modified in this manner, panels can be obtained of substantially better quality than those obtainable from the traditional plant.

The gluing machine of the present invention can be located in other suitable positions in a plant for producing wood fibreboard panels by a dry process. For example the gluing machine can be used directly in combination with the drier indicated by 18 in FIG. 1, to hence obtain a plant somewhat similar to that shown in FIG. 2.

In this case there is no need for the gluing machine to be provided with the mixing means, as the air flow originating from the drier is normally more than sufficient to obtain good fibre mixing.

BRIEF DESCRIPTION OF THE DRAWINGS

The invention will be more apparent from the following description of two embodiments thereof. In this description reference is made to FIGS. 1 to 5 of the accompanying drawings, in which.

DETAILED DESCRIPTION OF THE PREFERRED EMBODIMENTS

Figure 1:
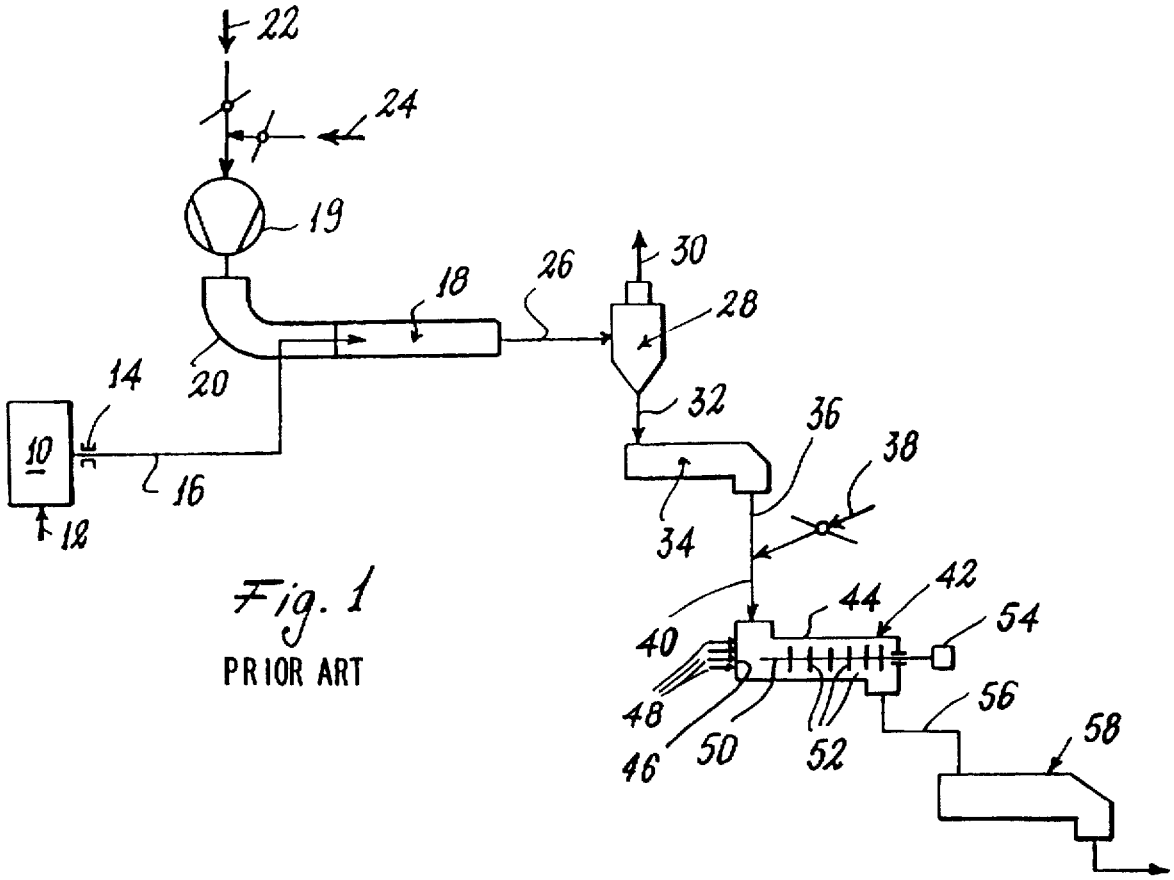
Fig. 1 PRIOR ART
FIG. 1 is a schematic view of a prior art traditional plant for producing medium density fibreboard panels.

Hereinafter, parts which are identical or performing similar functions to those of FIG. 1 are indicated by the same reference numeral as in FIG. 1 plus 200.

Figure 3:
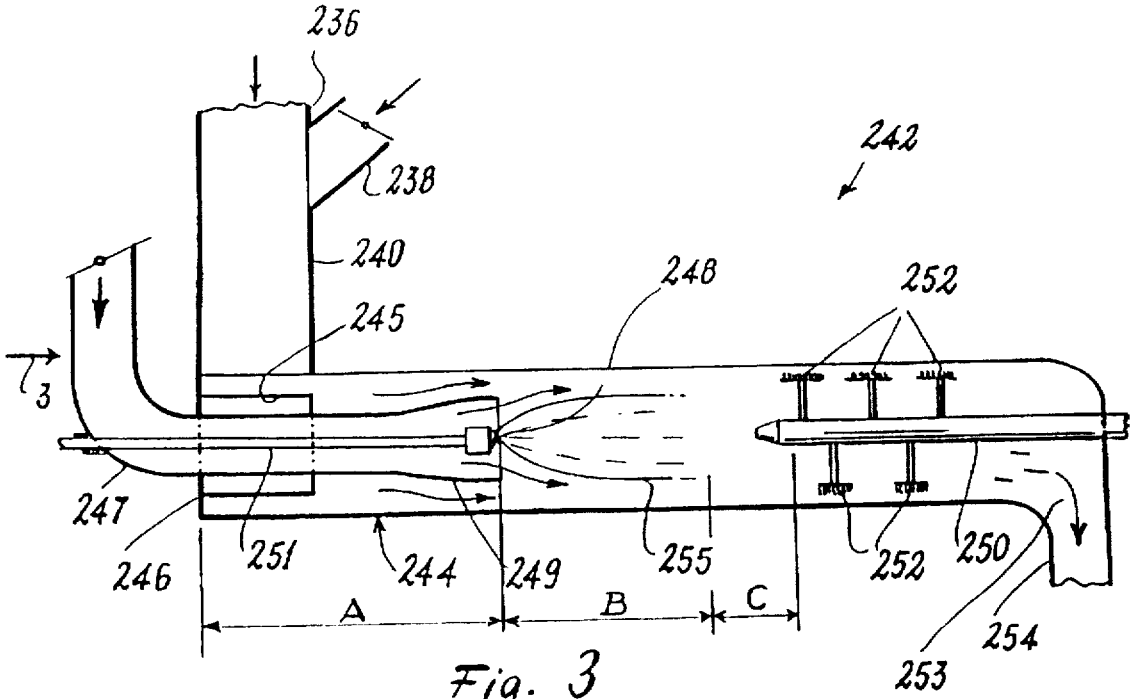
FIG. 3 is a schematic vertical, coaxial longitudinal section through a first embodiment of the gluing machine of the present invention, this gluing machine being suitable for replacing the conventional gluing machine 42 of FIG. 1.
Figure 4:
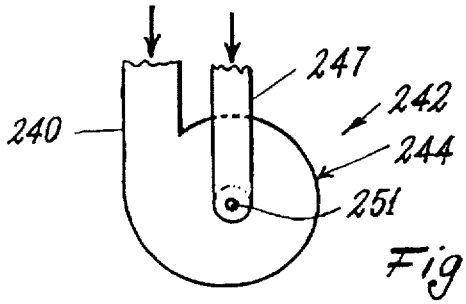
FIG. 4 is a view thereof in the direction of the arrow 3 of FIG. 3.

With reference to FIGS. 3 and 4, the gluing machine, indicated overall by 242, comprises a hollow cylindrical shell 244 of circular cross-section. At the left end of the cylindrical shell 244 there is provided an inlet opening 245 through which a stream of air transporting the fibers in a previously metered quantity is fed tangentially to the gluing machine 242 via a feed pipe 240. The fibers, originating from a cyclone separator such as 28 of FIG. 1 and metered in a weigher such as that indicated by 34 in the same figure, reach the feed pipe 240 of the gluing machine 242 from the duct 236. The left end 246 of the cylindrical shell 244 is traversed by a pipe 247 which extends coaxially for a certain distance within the cylindrical shell 244, the inner end 249 of the pipe 247 being open. Coaxially with the internal portion of the pipe 247 there is a tube 251 terminating, in proximity to the end 249 of the pipe 247, with a sprayer means consisting of a nozzle 248. This latter generates a conical spray of suitable contained angle.

In the right terminal portion (FIG. 3) of the gluing machine 242 there is provided a mixing means of traditional type, comprising a rotatable shaft 250 provided with paddles 252, said shaft projecting through a suitable opening in the right end of the cylindrical shell 244 and being rotated by an external motor (not shown). At the right end of the gluing machine 242 there is an outlet opening 253 and a relative exit pipe 254 for conveying the fibers sprayed with glue to the subsequent conventional operations.

The operation of the aforedescribed gluing machine 244 is briefly as follows. The air stream and fibers fed through the pipe 240 and entering the gluing machine tangentially through the inlet opening 245 are distributed within the annular space between that portion of the pipe 247 within the cylindrical shell 244 and the corresponding inner surface of this latter, to obtain in the first part of the cylindrical shell 244 (indicated by A in FIG. 3) a cyclonic distribution of the fibers (which along this distance describe basically a roughly helical trajectory). Simultaneously, into the outer end of the pipe 247 there is fed an auxiliary air stream of suitable pressure, throughput and velocity, chosen on the basis of the result to be obtained. This auxiliary air stream opens into the cylindrical shell 244 via the slightly flared end 249 of the pipe 247. Because of the action of the auxiliary air stream, the annular air stream which transports the fibers is maintained, for a certain distance downstream of the end 249 of the pipe 247, adjacent to the inner surface of the cylindrical shell 244. In this respect, the central space of the annular flow tube of this latter cyclonic air and fiber stream is occupied by the auxiliary air stream leaving the pipe 247. On feeding a suitable pressurized liquid adhesive substance into that end of the tube 251 external to the cylindrical shell 244, there emerges from the spray nozzle 248 a conical spray of adhesive substance having a contained angle chosen on the basis of the results to be obtained. By the effect of the auxiliary air stream, this spray is entrained downstream to assume a brush configuration shown schematically in FIG. 3 and indicated by the reference numeral 255. Consequently, through a certain distance (indicated by B in FIG. 3) downstream of the spray nozzle 248 there is atomization of the adhesive substance (atomization zone). Downstream of the zone B the air stream which transports the fibers and the auxiliary air stream which transports the glue particles mix together, so that there is an actual gluing zone (indicated by C in FIG. 3) in which the particles of adhesive substance are picked up by the fibers. The overall air stream, transporting the already glue-impregnated fibers, then leaves the gluing machine through the opening 253, to be fed to subsequent conventional moulding operations.

With the aforedescribed gluing machine it is possible to achieve a much more uniform distribution of adhesive substance within the fibre mass than with known gluing machines, resulting in a substantial improvement in the quality of the final plant product. If the gluing machine is also provided with mixing means (for example the rotatable shaft 250 with the relative paddles 252), the performance of the gluing machine of the present invention can be further improved. It should be noted that the mixing means are not essential, the same result being also achieved by increasing the auxiliary air throughput.

The nozzle 248 which sprays the liquid adhesive substance can be of low pressure type, so that compressed air is fed into the adhesive substance (water plus glue), or of high pressure type (without compressed air), in which the adhesive substance pressure can reach 300 bar.

It should be noted that the sprayer means 248 can also consist of several nozzles, provided that they are struck by the auxiliary air stream. What is important is that a good glue distribution within the fiber mass is achieved.

Figure 5:
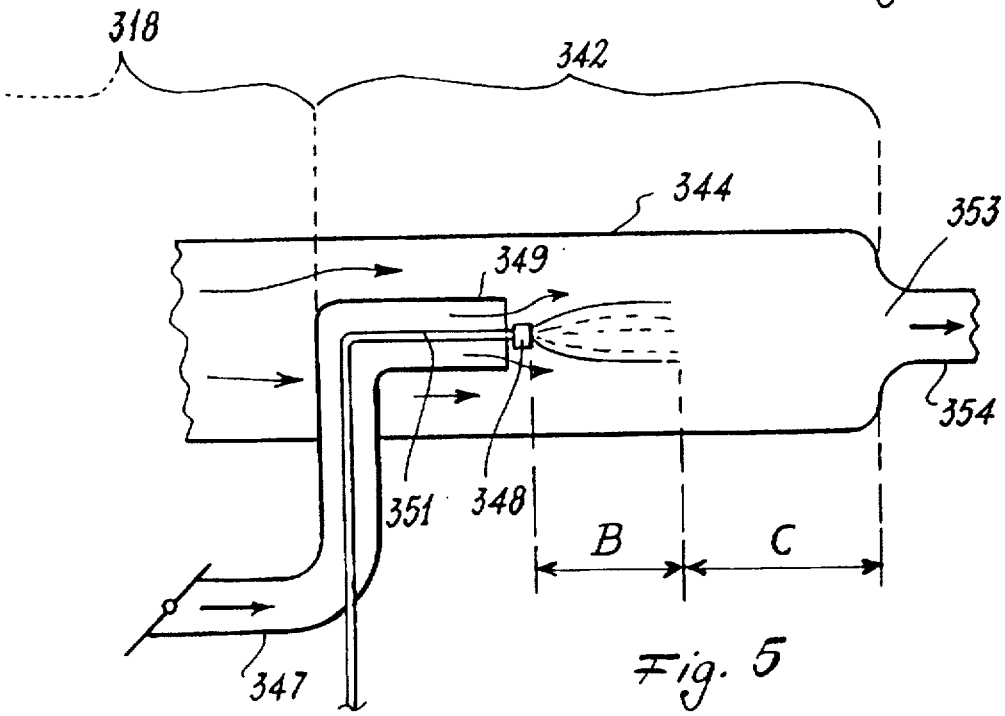
FIG. 5 is a longitudinal section through a second embodiment of the gluing machine of the invention, this gluing machine being suitable for combination with the drier 18 of FIG. 1.

As already stated, the gluing machine of the present invention can also be located in other positions within a plant for producing wood fibreboard panels by a dry process, provided that the conditions required for operation of the gluing machine (adequate air throughput and adequate temperature range) exist or are created. In particular, in the plant of FIG. 1, it has proved convenient to locate the gluing machine directly downstream of the drier 18 of the plant of FIG. 1. In FIG. 5 a gluing machine of this type is shown schematically, in which parts equal to or of similar function to those of FIGS. 4 and 1 are indicated by adding 100 and 300 to the relative reference numeral.

The gluing machine 342 has a hollow cylindrical shell which is basically an extension of the casing of the drier 318 (shown only partially), this latter being of the same type as the drier 18 of FIG. 1. The cylindrical shell 344 of the gluing machine 342 is traversed radially by a pipe 347, this latter then bending towards downstream, to coaxially follow the hollow shell 344 for a certain distance and then terminate with an open end 349. Coaxially to that portion of the pipe 347 within the hollow shell 344 there is a pipe which terminates, in the vicinity of the open end 349 of the pipe 347, with a sprayer means consisting of a nozzle 348 which produces a conical spray of suitable contained angle. At the right end (FIG. 5) of the gluing machine 342 there is an outlet opening, with relative exit pipe 354, for removing the glue-impregnated fibres.

The operation of the gluing machine 342 should be apparent from the preceding. The following should however be noted. The hot air stream which transports the fibres dried in the drier 318 passes directly into the gluing machine 342, into the annular space between the inner surface of the cylindrical shell 344 and the coaxial inner portion of the pipe 347. Simultaneously, into the outer end of the pipe 347 an auxiliary air stream is fed having a suitable throughput, velocity and pressure for obtaining the desired results.

Figure 2:
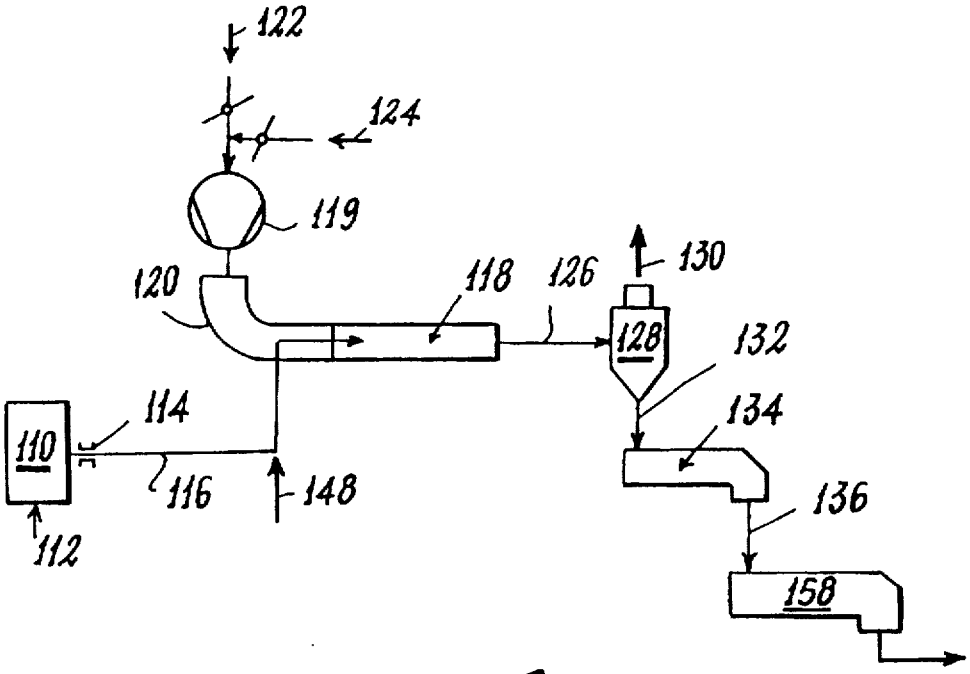
Fig. 2 PRIOR ART
FIG. 2 is a schematic view of a prior art blow-line or glue-line plant for producing medium density fibreboard panels.

The auxiliary air stream opens into the cylindrical shell 344 via the end 349 of the pipe 347, so that the air stream transporting the fibres is maintained, for a certain distance downstream of the end 349 of the pipe 347, adjacent to the inner surface of the cylindrical shell 344, the central space of the relative annular flow tube being occupied by the auxiliary air stream. On feeding a suitable pressurized liquid adhesive substance into the outer end of the tube 351, there emerges from the spray nozzle 348 a conical spray having a convenient contained angle. By the effect of the auxiliary air stream the spray assumes a brush configuration 355 shown in FIG. 5. Consequently for a certain distance (indicated by B in FIG. 5) downstream of the nozzle 348 there is an atomization zone, downstream of which the two air streams mix together to form the actual gluing zone C. The overall air stream then leaves from the outlet opening 353 and is fed via the pipe 354 to a cyclone similar to that indicated by 128 in FIG. 2. The remainder of the plant is of conventional type and is similar to that illustrated and described with reference to FIG. 2.

Finally, it should be noted that whether using the gluing machine 242 of FIGS. 3 and 4 or that of FIG. 5, a fiber mass is obtained in which the glue distribution is substantially better than in the known gluing machines of conventional plants, and comparable with, if not better than, that obtainable in blow-line plants (without a gluing machine), in both cases obtaining a panel of excellent quality as the final product.

It should also be noted that with the gluing machine 342 of FIG. 5 the glue is added just after the drier 318, i.e., at a point in which the temperature of the air and fiber stream is considerably lower (60°–70° C.) that at the drier inlet (where the temperature reaches 200° C. and more). In this manner the reactivity loss of the glue is negligible, while in a blow-line plant the reactivity loss due to the fact that the glue is subjected to a temperature of 200° C. or more is significant and results in a substantial increase in glue consumption. This serious drawback is avoided by using the machine 342 combined with the drier 318.

I claim:

1. A gluing machine usable in plants for producing wood fibreboard panels by a dry process, comprising a hollow cylindrical shell having an inlet opening at a first end, an outlet opening at a second end opposed to said first end and an inner wall, directing means for directing an air stream containing fibers to be glued and molded together to form the fibreboard panels into said inlet opening of said shell and through an interior of said shell, maintaining means for maintaining the fibers in the fiber-containing air stream in proximity to said inner wall of said shell for a predetermined distance, said maintaining means comprising a pipe arranged at least partially within said shell and having an open end within said shell, at least a portion of said pipe being coaxial with said shell such that an auxiliary air flow separate from the fiber-containing air stream passes through said pipe, out of said open end of said pipe and in a direction which is the same as a direction of flow of the fiber-containing air stream to prevent the fiber-containing air stream from moving into a central region of said shell over said predetermined distance and thus maintain the fibers in the fiber-containing air stream in proximity to said inner wall of said shell for said predetermined distance, spray means for spraying an adhesive substance into said interior of said shell between said inlet opening and said outlet opening, said spray means being arranged within said auxiliary air flow such that the adhesive is sprayed within said predetermined distance in which the fibers in the fiber-containing air stream are maintained in proximity to said inner wall of said shell, the adhesive mixing with the fibers in the fiber-containing air stream after said predetermined distance, and removal means for removing the air stream including the fibers mixed with the adhesive from said outlet opening of said shell.

2. The gluing machine of claim 1, wherein said directing means are structured and arranged to direct the fiber-containing air stream in a direction tangential to said inner wall of shell to form a cyclonic flow of the fiber-containing air stream in an initial portion of said shell.

3. The gluing machine of claim 1, wherein the plant includes a drier in which the fibers are dried, further comprising conduit means for passing the fibers from an outlet opening of the drier to said inlet opening of said shell.

4. The gluing machine of claim 1, further comprising mixing means for mixing the fibers and the adhesive arranged at a location in said shell downstream of the location at which the adhesive is sprayed by said spray means into said interior of said shell.

5. The gluing machine of claim 4, wherein said mixing means comprises a rotatable shaft and radial paddles coupled to said shaft and arranged coaxially to said shell.

6. The gluing machine of claim 1, wherein said spray means comprise a sprayer arranged within said pipe at said open end of said pipe such that the adhesive is sprayed from said sprayer beyond said open end of said pipe.

7. The gluing machine of claim 6, wherein said spray means further comprise a supply tube arranged at least partially within said pipe for supplying said sprayer with the adhesive.

8. The gluing machine of claim 1, wherein said spray means comprise a sprayer arranged outside of said pipe.

9. The gluing machine of claim 8, wherein said spray means further comprise a supply tube arranged at least partially within said pipe for supplying said sprayer with the adhesive.

10. The gluing machine of claim 1, wherein said pipe includes an outwardly flared portion adjacent said open end.

11. The gluing machine of claim 1, wherein said pipe extends into the interior of said shell through said inner wall of said shell.

12. The gluing machine of claim 1, wherein said pipe extends into the interior of said shell through a side wall of said shell proximate said inlet opening of said shell.

13. The gluing machine of claim 1, wherein said inlet opening of said shell is situated in said inner wall of said shell.

14. In a plant for producing wood fibreboard panels by a dry process including means for generating wood fibers, means for drying the wood fibers, means for metering the dried wood fibers, means for gluing the wood fibers and means for molding the glued wood fibers, said gluing means being arranged between said metering means and said molding means, the improvement comprising said gluing means comprising a hollow cylindrical shell having an inlet opening at a first end, an outlet opening at a second end opposed to said first end and an inner wall, directing means for directing an air stream containing the fibers into said inlet opening of said shell and through an interior of said shell, maintaining means for maintaining the fibers in the fiber-containing air stream in proximity to said inner wall of said shell for a predetermined distance, said maintaining means comprising a pipe arranged at least partially within said shell and having an open end within said shell, at least a portion of said pipe being coaxial with said shell such that an auxiliary air flow separate from the fiber-containing air stream passes through said pipe, out of said open end of said pipe and in a direction which is the same as a direction of flow of the fiber-containing air stream to prevent the fiber-containing air stream from moving into a central region of said shell over said predetermined distance and thus maintain the fibers in the fiber-containing air stream in proximity to said inner wall of said shell for said predetermined distance, spray means for spraying an adhesive substance into said interior of said shell between said inlet opening and said outlet opening, said spray means being arranged within said auxiliary air flow such that the adhesive is sprayed within said predetermined distance in which the fibers in the fiber-containing air stream are maintained in proximity to said inner wall of said shell, the adhesive mixing with the fibers in the fiber-containing air stream after said predetermined distance, and removal means for removing the air stream including the fibers mixed with the adhesive from said outlet opening of said shell.

15. The plant of claim 14, further comprising conduit means for passing the fibers from an outlet opening of said drying means directly to said inlet opening of said shell.

16. The plant of claim 14, wherein said gluing means further comprise mixing means for mixing the fibers and the adhesive arranged at a location in said shell downstream of the location at which the adhesive is sprayed by said spray means into the air stream containing the fibers.

17. The plant of claim 14, wherein said spray means comprise a sprayer arranged within said pipe at said open end of said pipe such that the adhesive is sprayed from said sprayer beyond said open end of said pipe, and a supply tube arranged at least partially within said pipe for supplying said sprayer with the adhesive.

18. The plant of claim 14, wherein said spray means comprise a sprayer arranged outside of said pipe, and a supply tube arranged at least partially within said pipe for supplying said sprayer with the adhesive.

19. In a plant for producing wood fibreboard panels by a dry process including means for generating wood fibers, a dryer for drying the wood fibers, means for metering the dried wood fibers, means for gluing the wood fibers and means for molding the glued wood fibers, said gluing means being arranged in said dryer, the improvement comprising said dryer comprising a hollow cylindrical shell having an inlet opening at a first end, an outlet opening at a second end opposed to said first end and an inner wall, directing means for directing an air stream containing the fibers into said inlet opening of said shell and through an interior of said shell, and removal means for removing the fibers from said outlet opening of said shell; and said gluing means comprising maintaining means for maintaining the fibers in the fiber-containing air stream in proximity to said inner wall of said shell for a predetermined distance, said maintaining means comprising a pipe arranged at least partially within said shell and having an open end within said shell, at least a portion of said pipe being coaxial with said shell such that an auxiliary air flow separate from the fiber-containing air stream passes through said pipe, out of said open end of said pipe and in a direction which is the same as a direction of flow of the fiber-containing air stream to prevent the fiber-containing air stream from moving into a central region of said shell over said predetermined distance and thus maintain the fibers in the fiber-containing air stream in proximity to said inner wall of said shell for said predetermined distance, and spray means for spraying an adhesive substance into said interior of said shell between said inlet opening and said outlet opening, said spray means being arranged within said auxiliary air flow such that the adhesive is sprayed within said predetermined distance in which the fibers in the fiber-containing air stream are maintained in proximity to said inner wall of said shell, the adhesive mixing with the fibers in the fiber-containing air stream after said predetermined distance.

20. The plant of claim 19, wherein said gluing means further comprise mixing means for mixing the fibers and the adhesive arranged at a location in said shell downstream of the location at which the adhesive is sprayed by said spray means into the air stream containing the fibers.

* * * * *